US007040342B1

(12) United States Patent
Stehling et al.

(10) Patent No.: US 7,040,342 B1
(45) Date of Patent: May 9, 2006

(54) FIRE HYDRANT LOCK

(75) Inventors: Fred J. Stehling, Lodi, WI (US); Terry R. McWilliams, DeSoto, TX (US); Roy Istre, Jr., Corsicana, TX (US)

(73) Assignee: Custodian Patent, L.L.C., Irving, TX (US)

( * ) Notice: Subject to any disclaimer, the term of this patent is extended or adjusted under 35 U.S.C. 154(b) by 0 days.

(21) Appl. No.: 11/101,640

(22) Filed: Apr. 8, 2005

(51) Int. Cl.
*F16K 35/06* (2006.01)

(52) U.S. Cl. ..... 137/382; 137/327; 70/175; 251/291

(58) Field of Classification Search ..... 137/382, 137/377, 382.5, 327; 251/291; 70/175, 70/231, 232
See application file for complete search history.

(56) References Cited

U.S. PATENT DOCUMENTS 3,556,131 A * 1/1971 Diaz ..... 137/382.5
3,840,041 A * 10/1974 McMurray ..... 137/296
4,620,428 A * 11/1986 Kopesky ..... 70/175
4,716,922 A * 1/1988 Camp ..... 137/296

* cited by examiner

*Primary Examiner*—A. Michael Chambers
(74) *Attorney, Agent, or Firm*—Millen, White, Zelano & Branigan, P.C.

(57) ABSTRACT

A fire hydrant security arrangement includes a center post which is retained on the operating nut of the fire hydrant by a central bolt which is threaded into the operating nut. The center post has a pentagonal recess therein which receives an insert, the insert having an inner recess which corresponds in shape to the operating nut. A domed housing is slid over the operating nut and can rotate with respect thereto. A circular groove in the center post receives a projection from a security plug which has been threaded through a threaded bore in the domed housing. The security plug has a socket therein which includes a recess which is off-set slightly from the axis of the plug and is only operable by a security tool having an off-set projection that is receivable in the recess. Without possession of the security tool, it is very difficult to achieve sufficient purchase on the plug to rotate the plug and withdraw the plug sufficiently away from the circular groove in the center post to remove the domed housing. A person with the security tool can readily back the plug out of the socket so that the domed housing may be removed and the water valve of the fire hydrant opened by applying a standard fire hydrant wrench to a pentagonal surface on the center post.

20 Claims, 7 Drawing Sheets

FIRE HYDRANT LOCK

FIELD OF THE INVENTION

The present invention is directed to a fire hydrant lock, more particularly, the present invention is directed to a fire hydrant lock which prevents unauthorized activation of a water supply valve connected to the fire hydrant.

BACKGROUND OF THE INVENTION

In any water distribution system, fire hydrants are a direct access to public drinking water. Fire hydrants are attached to water mains to provide fire departments with quick access to a water source when needed to combat a fire. Any unauthorized access to this system presents a danger to the public. If fire hydrants are opened as recreational devices, this reduces water and pressures needed by the fire department in case of a fire emergency. Moreover, contractors are known to illegally take water from hydrants without using a meter and a backflow device, which not only costs the public money but substantially increase the danger of contaminating water systems. The amount of water consumed by contractors can be substantial when constructing large buildings or numbers of dwellings, or when simply taking water to fill swimming pools. In addition, terrorist threats to water systems are becoming a serious concern. In an attempt to address these problems, fire departments resort to fire hydrant locks that over time become increasingly subject to defeat as special operators for these locks are stolen or otherwise slip into unauthorized hands. Accordingly, there is a need for fire hydrant locks which minimize, for at least a substantial number of years, successful attempts to defeat the locks by unauthorized people.

SUMMARY OF THE INVENTION

In view of the aforementioned considerations, a fire hydrant security arrangement, for securing a fire hydrant having an operating nut of a configuration selected from plurality of configurations, comprises; a center port, a surface within the center port that cooperates with the operating nut post, a bolt for attaching the center post to the operating nut, a protective housing and a locking plug which is operated utilizing a security wrench having a specialized configuration.

In another aspect of the security arrangement, the center post has a first portion with a circular outer surface of a first diameter, the first portion having a circular groove therein. The center post has a second portion configured as a secured operating nut. A non-circular recess is disposed within the center post and an axial hole extends through the second portion and into the non-circular recess. An insert is provided having an outer surface configured to complement the non-circular recess within the center post and an inner surface configured to receive and complement the selected surface configuration of the operating nut of the fire hydrant. To secure the center post to the fire hydrant operating nut, a bolt is passed through the axial hole in the center post for fastening the center post to the fire hydrant operating nut in a non-rotational relationship. A protective housing, having a circular inner surface complementing the circular outer surface of the center post, fits over the center post to shield the center post from unauthorized attempts to operate the fire hydrant. The housing has a threaded bore extending therethrough and aligned with the circular groove in the center post. A locking plug is threaded through the threaded bore in the housing and has a portion received in the circular groove to rotationally retain the protective housing over the center post. The locking plug has a security feature of a shape selected to be coupled with a complementary shape of a security wrench wherein only a person having the operating wrench can remove the plug with out extreme difficulty to expose the secured operating nut on the center post.

In another aspect of the fire hydrant security arrangement, the security feature is a recess within the outer end of the plug that is off-set axially with respect to the axis of the plug, the complementary shape on the security wrench being an axially off-set projection which is received in the recess.

In further aspects of the fire hydrant security arrangement; the locking plug is made of stainless steel; the housing is made of galvanized ductile iron, and the center post and insert is made of brass.

In still another aspect of the invention, the insert is one insert selected from a group of inserts, each of which has a non-circular outer configuration complementing the non-circular configuration of the recess in the insert and wherein each insert has an inner recess selected to complement the surface of the operating nut on the fire hydrant.

In still further aspects of the invention, the recess in the insert is a polygon; the polygon is a pentagon, and the housing has a cylindrical side portion and a domed top portion.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
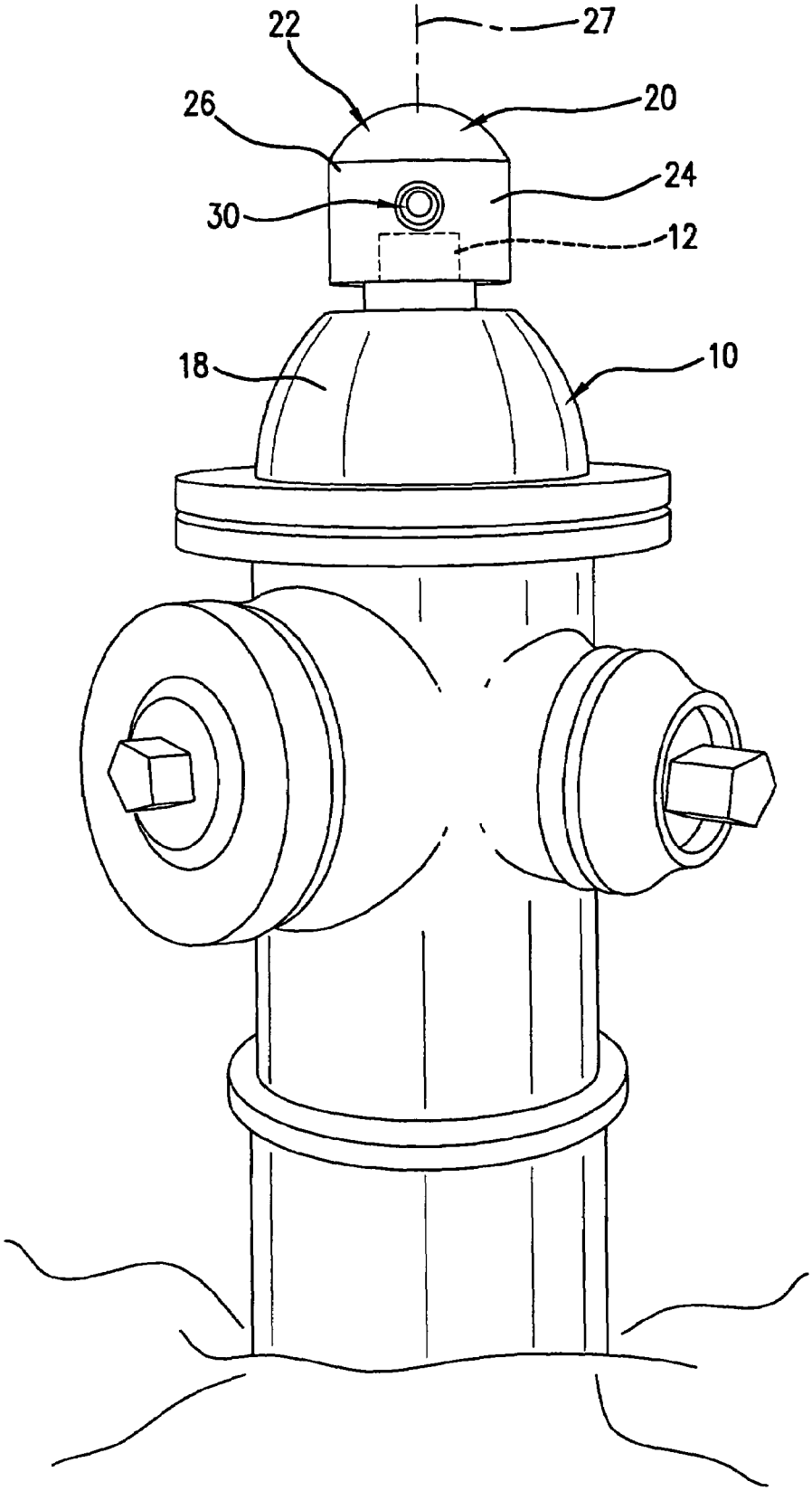
FIG. 1 is a perspective view of a fire hydrant having a fire hydrant security arrangement configured in accordance with the principles of the present invention.

Referring now to FIG. 1 there is shown a fire hydrant 10 having an operator nut 12 that opens a valve (not shown) to allow water to flow through outlets 14 and 16. The operator nut projects from a domed top 18 of the fire hydrant and is protected by a fire hydrant lock 20. As will explain hereinafter, the fire hydrant lock 20 includes a housing 22 which has a cylindrical portion 24 and a domed portion 26. When an unauthorized operator attempts to remove the fire hydrant lock 20 in order to gain access to the operating nut 12, the housing 22 spins on its axis 27. As will be further explained hereinafter, if one attempts to pry the housing 22 from the domed top 18 of the fire hydrant 10, a plug 30 engages a circular groove covered by the housing 22 to prevent movement of the housing in the direction of the axis 27.

Figure 2:
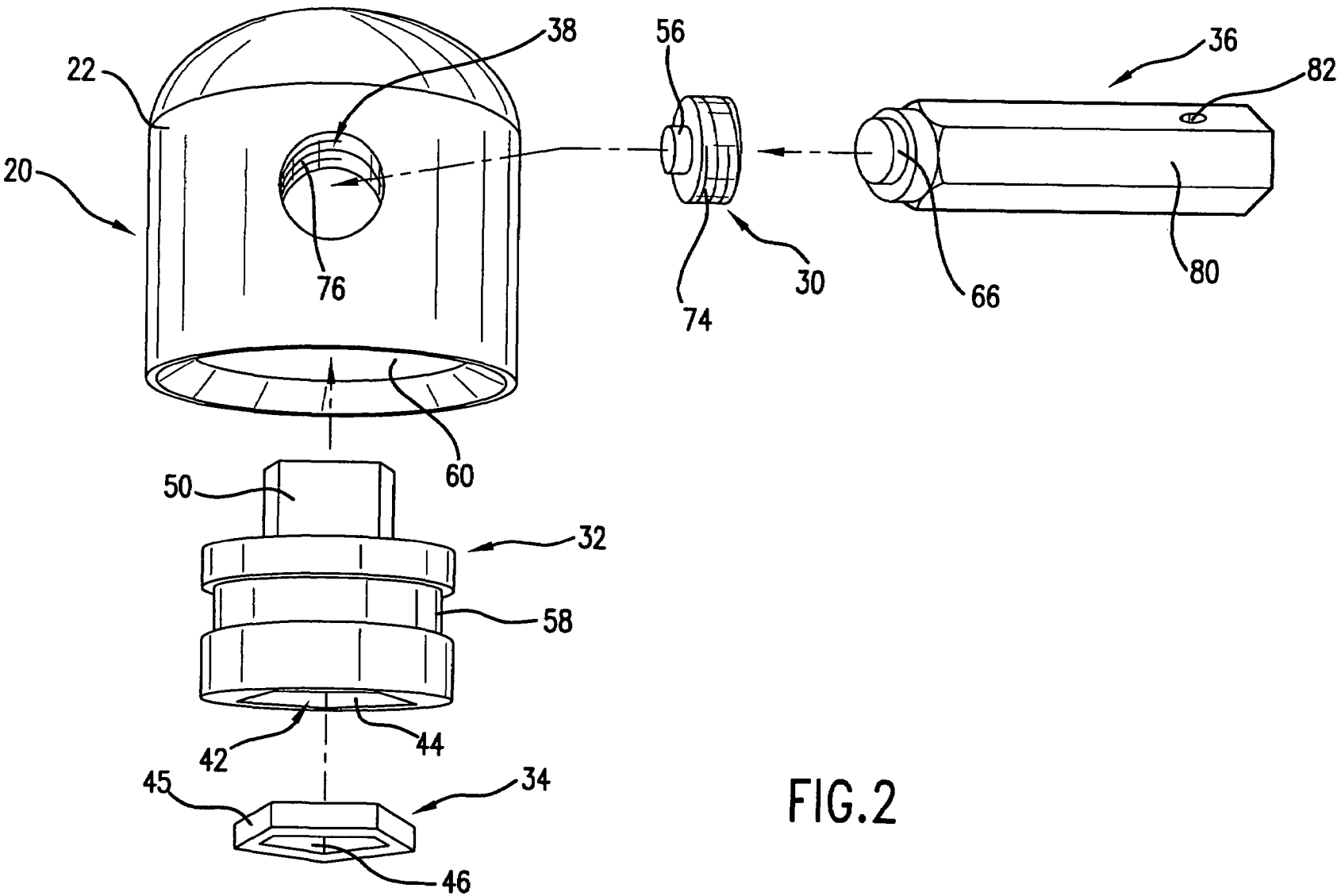
FIG. 2 is an exploded view showing the components of the security arrangement.

Referring now to FIG. 2, it is seen that the components of the security arrangement 20 include: the housing 22, the plug 30, a center post 32 which is disposed within the housing, an insert 34 that is received within the center post 32 and slidably receives the operating nut 12, and a security wrench 36 which is used to remove the security plug 30 from a threaded bore 38 in the housing 22. The components of the locking arrangement are assembled on the fire hydrant 10 of FIG. 1, with the insert 34 engaging the operating nut 12. The fire hydrant lock 20 is usually but not always installed as a retrofit. The security wrench 36 is in the possession of the fire fighting company and arrives at the fire hydrant in the possession of a fire fighter or other official authorized to carry the security wrench.

Figure 3:
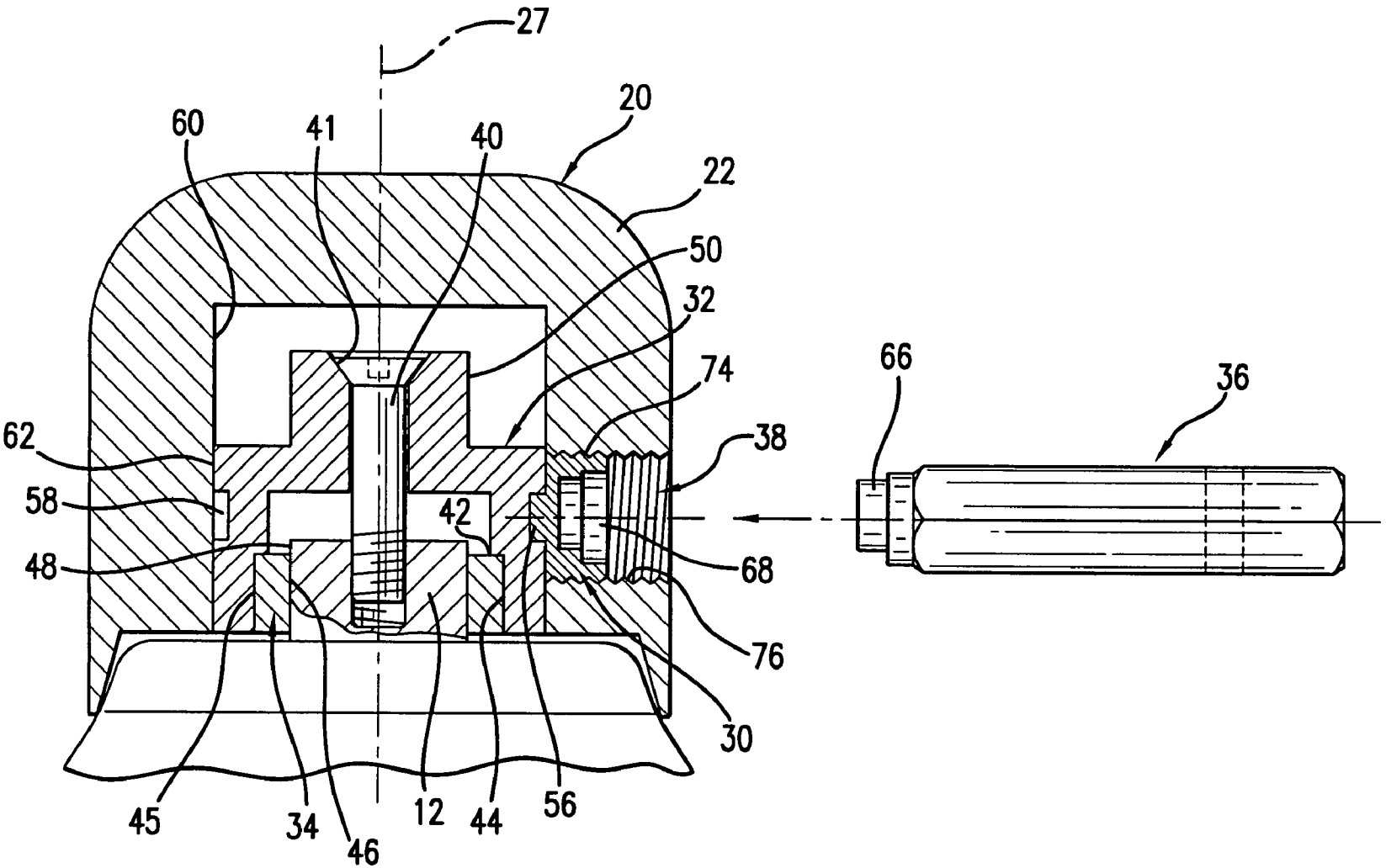
FIG. 3 is a side elevation showing the security arrangement in place over the operating nut of a fire hydrant, such as the fire hydrant of FIG. 1.

Referring now to FIG. 3, where an elevation of the fire hydrant lock 20 is shown mounted on the operating nut 12, it is seen that the fire hydrant lock is attached to the operating nut 12 by a bolt 40 through a counter-sunk hole 41 which is coaxial with the axis 27 of the fire hydrant lock. The insert 34 nests within a non-circular recess 42 of the center post 32. The recess 42 of the center post 32 has a non-circular inner wall 44 which complements a non-circular outer wall 45 of the insert 34. Consequently, the insert 34 will turn with the center post 32. The insert 34 has an interior surface 46 which complements the exterior surface 48 of the operating nut 12 so that as the insert 34 is turned by the center post 32, the operating nut 12 also rotates. The interfaces between the operating nut 12, the insert 42 and the center post 32 are preferably polygonal to facilitate its rotation, the center post 32 has a polygonal security nut portion 50 which is readily engageable by a regular fire hydrant wrench (not shown) which is usually applied to the operating nut 12 to open the fire hydrant valve.

In order to limit access to the polygonal nut 50, the domed housing 22 is slid thereover and retained by the security plug 30 which has a projection 56 which fits into a circular groove 58 in the center post 32. The projection 56 prevents the domed housing 22 from moving in the direction of axis 27. The domed housing 22 has a cylindrical inner surface which is disposed around a cylindrical outer surface 62 on the insert 32. Consequently, as the housing 22 is rotated about the axis 27, the housing rotates with respect to the insert 32. The housing 22 is also held in axial position with respect to the insert 32 by the projection 56 on the security plug 30 which is within the groove 58 on the center post 32.

In order to keep the security plug 30 from engaging the center post 32, the threaded opening 38 has an annular shoulder 59 at the inner end thereof through which the projection 56 passes. The end surface of the plug 30 adjacent to the projection abuts and tightens against the shoulder 59 so that substantial torque is necessary to turn the plug 30 in order to back the plug out of the threaded bore 38.

In order to remove the domed housing 22, the security plug 30 is backed out of the threaded hole 38 through the domed housing. This is accomplished by the security wrench 36 which has an off-set projection 66 that is received in an off-set recess 68 in the surface of the plug 30. Once sufficient torque is applied by the security wrench 36, the plug 30 backs out far enough so that the projection 56 clears the annular groove 58 in the center post 32 allowing the domed housing 22 to be slid axially off the center post 32. This exposes the security nut portion 50 on the center post 32, which can be turned by a standard fire hydrant wrench since the security nut portion 50 has the same configuration as the operating nut 12 of the fire hydrant.

Referring now to FIGS. 4A–4F it is seen that the insert 34 may have numerous configurations 34A–34F, wherein the inner surfaces 46A–46F may have several pentagonal configurations ranging from 1-inch to 1 3/16-inch widths. In each case, the inner surface 46A–46F defines a pentagon having a width ranging from 1-inch to 1½-inches. In each case however the exterior surface 45 remains the sample so as to always fit within the pentagonal surface 45 defining the recess 32. Consequently, the fire hydrant lock 20 can be made to fit various fire hydrant configurations regardless of the nut size 12.

Figure 4A:
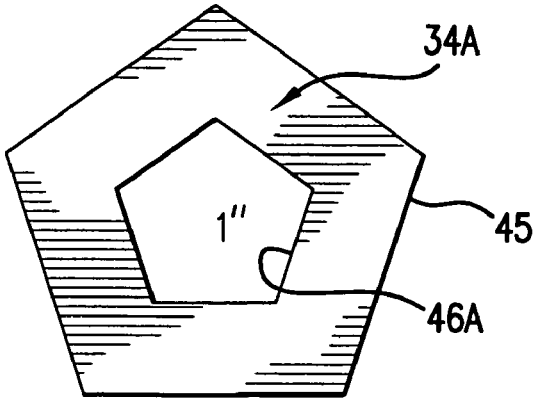
FIGS. 4A–4H are various configurations for an insert which adapts the security arrangement of FIGS. 1–3 to fire hydrants having operating nuts of various configurations.
Figure 4C:
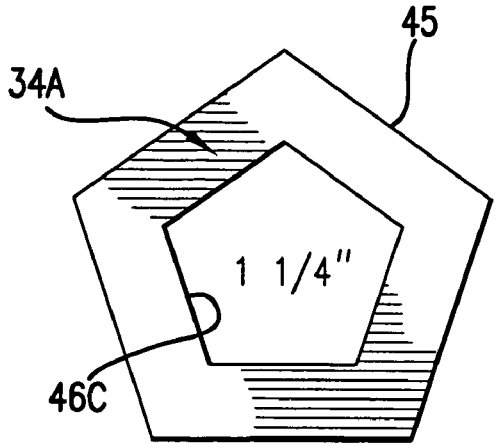
Figure 4B:
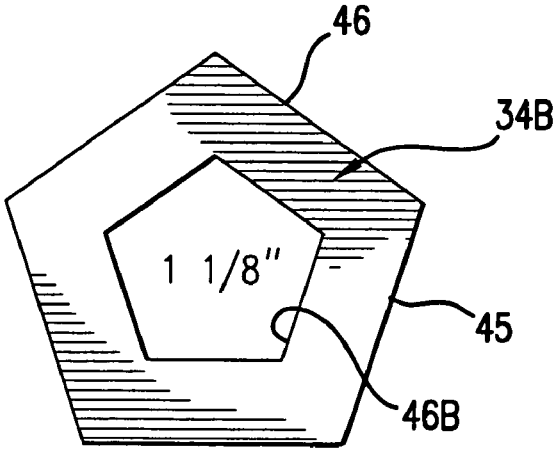
Figure 4D:
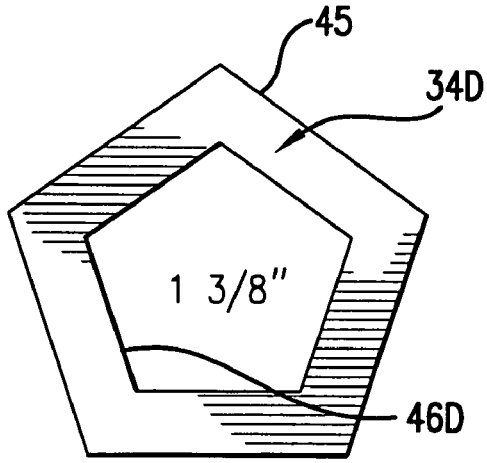
Figure 4E:
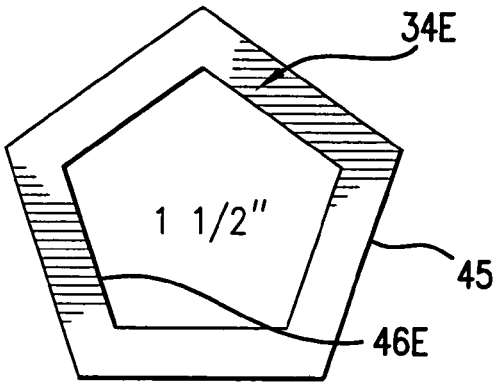
Figure 4G:
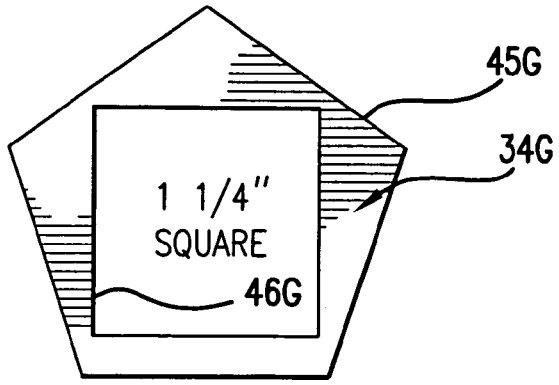
Figure 4F:
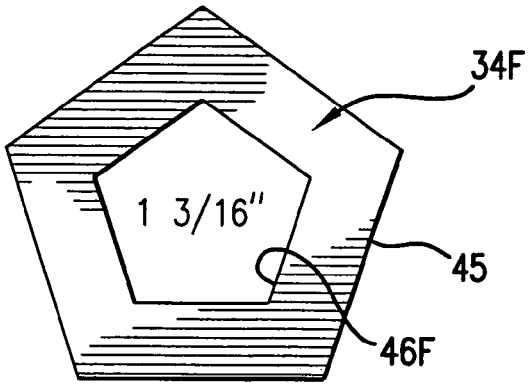
Figure 4H:
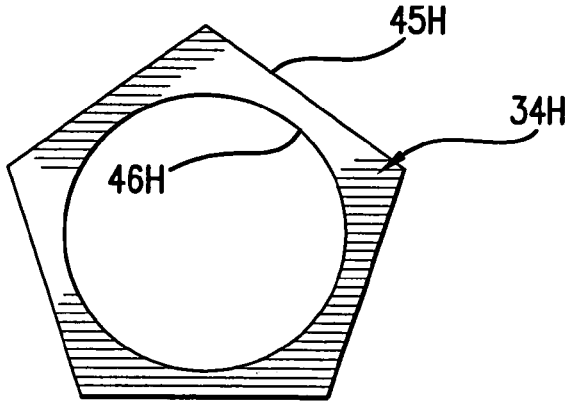

Referring now to FIGS. 34G and 34H, occasionally, the inner wall surface 46G of the insert 34 is square while the exterior surface 45G remains pentagonal, resulting in the insert configuration 34G of FIG. 4G. On occasion the fire hydrant operating nut 12 is cylindrical so that the inside insert surface 46H of the insert 34H is circular to accommodate the fire hydrant operating nut. Again, the outside surface 46H of the insert 34H is polygonal. By using inserts 34 of various configurations, the fire hydrant lock 20 may be readily adapted for use with any existing fire hydrant 10.

While having a plurality of inserts 34A–34H is a preferable embodiment of the fire hydrant lock 20, the lock has an embodiment wherein the recess 42 of the center post 32 fits the fire hydrant operating nut 12 directly without an insert. In this embodiment, the inserts 32 themselves are specially configured with an inner recess configured for the fire hydrant operating nuts 12 with which they are used.

Figure 5:
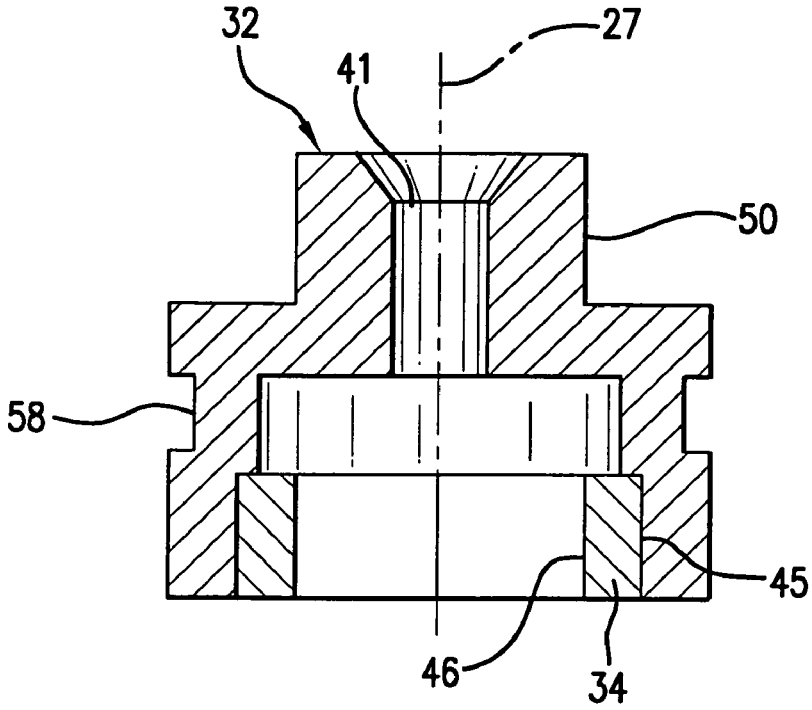
FIG. 5 is a side elevation of a center post which receives the inserts of FIGS. 4A–4H.
Figure 6:
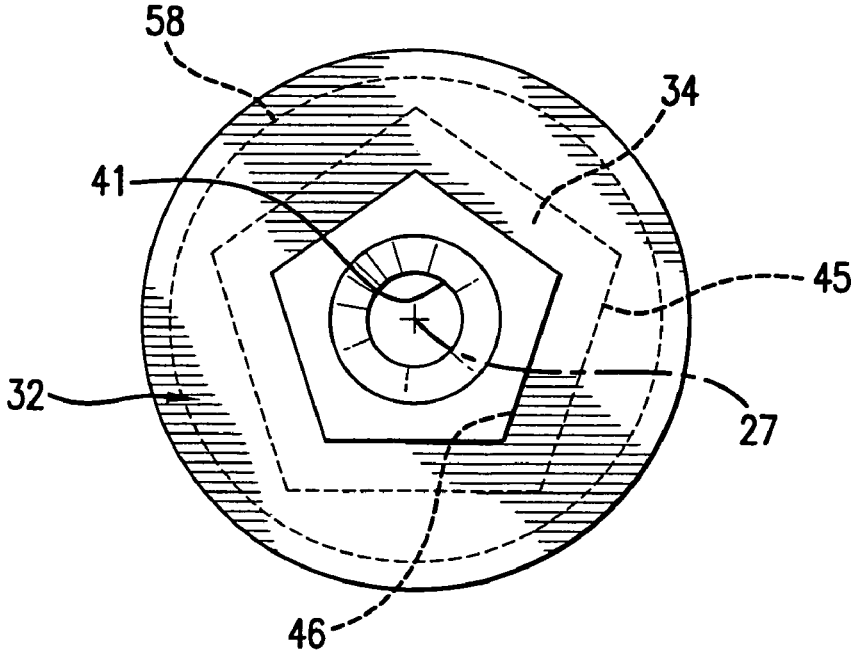
FIG. 6 is a top view of FIG. 5.
Figure 7:
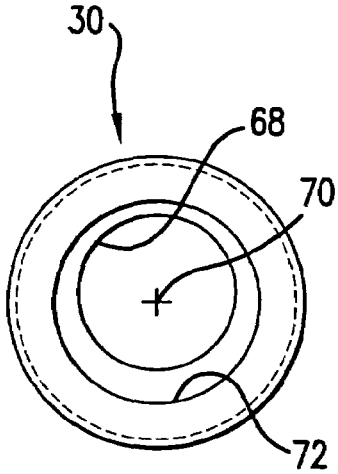
FIG. 7 is an end view of a security plug shown in FIGS. 2 and 3.
Figure 8:
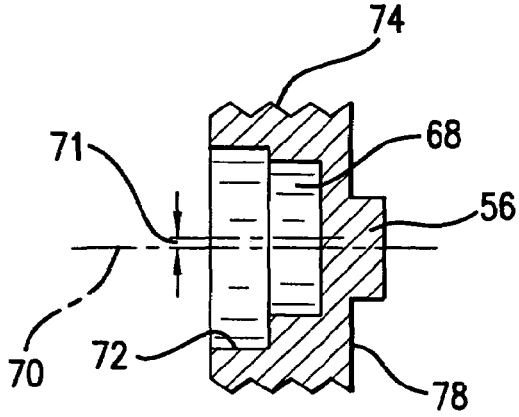
FIG. 8 is a side elevation of the security plug of FIG. 9.

Referring now to FIGS. 5 and 6 where the center post 32 is shown isolated, it is clearly seen that the groove 58 is circular and that the selected insert 34A–34H simply slides into place so that the assembly of the center post and selected insert are retained in nested relation with respect to the operating nut only by the bolt 40 (see FIG. 3). Accordingly, supplier of the fire hydrant lock 90 need only select the proper insert 34A–34H for the customer with the center post 32, housing 22, plug 30 and bolt 40 always being the same. This minimizes inventory expense and confusion.

Preferably, the center post 32 and the bolt 40 which fixes the center post on the operating nut 12 of the fire hydrant (see FIG. 3) are brass, as are the various inserts 34A–34H. The plug 30 is however made of stainless steel, while the domed housing 22 is made of ductile iron which has surfaces which have been galvanized by hot dipping.

Referring now to FIGS. 7–10 where the details of the plug 30 and security tool 36 are shown, it is seen that the round recess 68 in the plug 30 is off-set from the axis 70 of the plug by a slight amount. In the illustrated embodiment, the off-set 71 is only 0.032 inch. Outboard of the recess 68 there is a circular, inwardly facing shoulder 72. The circular shoulder 72 is coaxial with the axis 70. The plug 30 has an external thread 74 which threads with an internal thread 76 in the bore 38 (FIG. 3) as the plug 30 is rotated about its axis 70 until the projection 56 is received in the circular groove 58 in the center post 32 (FIG. 3).

Figure 9:
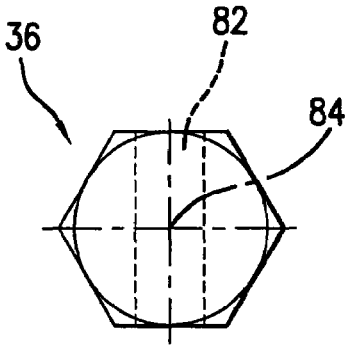
FIG. 9 is a side view of a security wrench used to extract and tighten the security plug of FIGS. 8 and 9.
Figure 10:
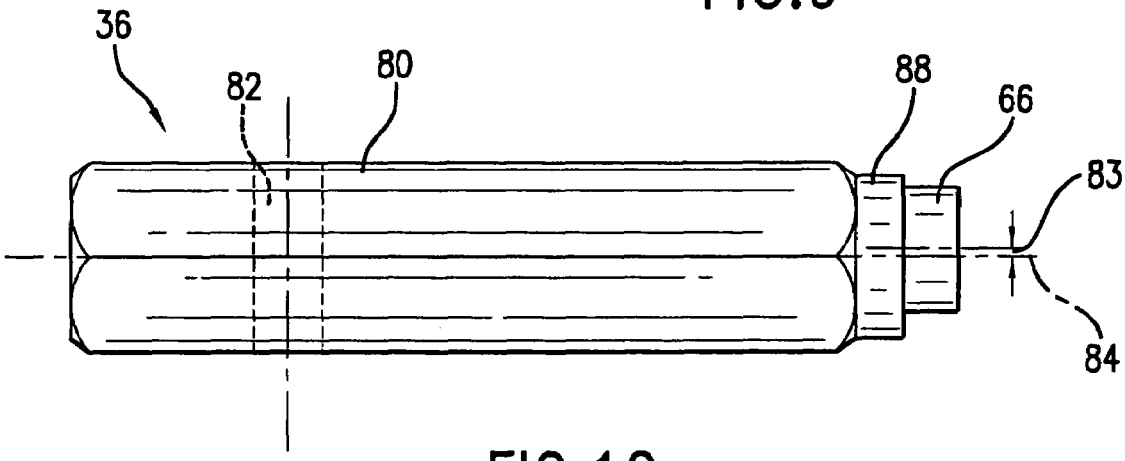
FIG. 10 is an end view of the wrench of FIG. 9.

The security wrench 36 is shown in FIGS. 9 and 10 and includes a hexagonal handle 80 with a bore 82 therethrough for receiving an operating rod in case the plug 30 is screwed in very tightly. The security tool 36 has the projection 66 which is receivable in the recess 68 and also has an off-set 83 of about 0.032 from the wrench axis 84. When the projection 66 is inserted into the hole 68 and a collar portion 88 on the wrench 36 is within the circular shoulder 22, substantial purchase occurs when the security tool 36 is rotated about its axis 84 that in operation is aligned with the axis 70 of the plug 30. By having the plug 30 made of stainless steel and the recess 68 within the socket in the plug round, it is very difficult for an unauthorized person to achieve sufficient purchase with a tool so as to rotate and withdraw the plug from the hole 38.

From the foregoing description, one skilled in the art can easily ascertain the essential characteristics of this invention, and without departing from the spirit and scope thereof, can make various changes and modifications of the invention to adapt it to various usages and conditions.

We claim:

1. A fire hydrant security arrangement, for securing a fire hydrant having an operating nut of a surface configuration selected from plurality of configurations, comprising:

a center post having a first portion with a circular outer surface of a first diameter and having a circular groove therein, the center post having a second portion configured as a security operating nut;

a non-circular recess within the center post and an axial hole extending through the second portion and into the non-circular recess;

an insert having an outer surface configured to complement the non-circular recess within the center post and an inner surface configured to receive and complement the selected surface configuration of the operating nut on the fire hydrant;

a bolt for passage through the axial hole in the center post and the non-circular recess within the center post for fastening to the operating nut to fix the center post to the operating nut in a non-rotational relationship;

a protective housing having a circular inner surface complementing the circular outer surface of the center post and fitting thereover to shield the center post from unauthorized attempts to operate the fire hydrant;

a threaded bore extending through the housing and aligned with the circular groove in the center post;

a locking plug threaded through the threaded bore through the housing and having a portion received in the circular groove, the locking plug having a security feature of a shape selected to be coupled with a complementary shape on a security wrench, whereby only a person having the security wrench can remove the plug without extreme difficulty.

2. The fire hydrant security arrangement of claim 1 wherein the security feature is a recess within an outer end of the plug which is off-set axially from the axis of the plug, and wherein the complementary shape on the security wrench is an axial off-set projection which is receivable in the recess.

3. The fire hydrant security arrangement of claim 2 wherein the locking plug is made of stainless steel.

4. The fire hydrant security arrangement of claim 3 wherein the housing is made of galvanized ductile iron.

5. The fire hydrant security arrangement of claim 4 wherein the center post and insert are made of brass.

6. The fire hydrant security arrangement of claim 1 wherein the insert is one insert selected from a group of inserts and wherein each insert in the group of inserts has a non-circular outer configuration complementing the non-circular configuration of the recess in the center post and having an inner recess selected to complement the surface of operating nut on the hydrant.

7. The fire hydrant security arrangement of claim 6 wherein the recess in the insert is a polygon.

8. The fire hydrant security arrangement of claim 7 wherein the polygon is a pentagon.

9. The fire hydrant security arrangement of claim 1 wherein the housing has a cylindrical side portion and a domed top portion.

10. The fire hydrant security arrangement of claim 9 wherein the housing is made of galvanized ductile iron.

11. A fire hydrant security arrangement, for securing a fire hydrant having an operating nut of a surface configuration selected from plurality of configurations, comprising:

a center post having a first portion with a circular outer surface of a first diameter and having a circular groove therein, the center post having a second portion configured as a security operating nut;

a non-circular recess within the center post and an axial hole extending through the second portion and into the non-circular recess; the non-circular recess being configured to complement the surface configuration of the operating nut of the fire hydrant;

a bolt for passage through the axial hole in the center post and the non-circular recess within the center post for fastening to the operating nut to fix the center post to the operating nut in a non-rotational relationship;

a protective housing having a circular inner surface complementing the circular outer surface of the center post and fitting thereover to shield the center post from unauthorized attempts to operate the fire hydrant;

a threaded bore extending through the housing and aligned with the circular groove in the center post;

a locking plug threaded through the threaded bore through the housing and having a portion received in the circular groove, the locking plug having a security feature of a shape selected to be coupled with a complementary shape on a security wrench, whereby only a person having the security wrench can remove the plug without extreme difficulty.

12. The fire hydrant security arrangement of claim 11 wherein the security feature is a recess within an outer end of the plug which is off-set axially from the axis of the plug, and wherein the complementary shape on the security wrench is an axial off-set projection which is receivable in the recess.

13. The fire hydrant security arrangement of claim 12 wherein the locking plug is made of stainless steel.

14. The fire hydrant security arrangement of claim 13 wherein the housing is made of galvanized ductile iron.

15. The fire hydrant security arrangement of claim 14 wherein the center post and insert are made of brass.

16. The fire hydrant security arrangement of claim 11 wherein the non-circular surface is on an insert which is one insert selected from a group of inserts and wherein each insert in the group of inserts has a non-circular outer configuration complementing a non-circular configuration of a recess in the center post, the insert having an inner recess selected to complement the surface of operating nut on the hydrant.

17. The fire hydrant security arrangement of claim 16 wherein the recess in the insert is a polygon.

18. The fire hydrant security arrangement of claim 17 wherein the polygon is a pentagon.

19. The fire hydrant security arrangement of claim 11 wherein the housing has a cylindrical side portion and a domed top portion.

20. The fire hydrant security arrangement of claim 18 wherein the housing is made of galvanized ductile iron.

* * * * *